US006752109B2

(12) United States Patent
Marforio et al.

(10) Patent No.: US 6,752,109 B2
(45) Date of Patent: Jun. 22, 2004

(54) IGNITION ELECTRODE ARRANGEMENT AT AN INTERNAL COMBUSTION ENGINE

(75) Inventors: Karl Marforio, Trollhattan (SE); Alf Hedlund, Skelleftea (SE)

(73) Assignee: Saab Automobile AB (SE)

( * ) Notice: Subject to any disclaimer, the term of this patent is extended or adjusted under 35 U.S.C. 154(b) by 0 days.

(21) Appl. No.: 10/182,684

(22) PCT Filed: Jan. 25, 2001

(86) PCT No.: PCT/SE01/00141

§ 371 (c)(1),
(2), (4) Date: Oct. 11, 2002

(87) PCT Pub. No.: WO01/56124

PCT Pub. Date: Aug. 2, 2001

(65) Prior Publication Data

US 2003/0089325 A1 May 15, 2003

(30) Foreign Application Priority Data

Jan. 28, 2000 (SE) ..... 0000268

(51) Int. Cl.[7] ..... F02P 15/04
(52) U.S. Cl. ..... 123/159; 123/164
(58) Field of Search ..... 123/169 EA, 169 EC, 123/169 MG, 159, 161, 164

(56) References Cited

U.S. PATENT DOCUMENTS

| | | | | | |
|---|---|---|---|---|---|
| 907,002 | A | | 12/1908 | Brownback | |
| 1,009,084 | A | | 11/1911 | Meacham | |
| 2,031,293 | A | | 2/1936 | Wamelink | 123/169 |
| 5,720,252 | A | * | 2/1998 | Blodgett et al. | 123/298 |
| 6,453,862 | B1 | * | 9/2002 | Holzmann | 123/162 |

FOREIGN PATENT DOCUMENTS

| | | |
|---|---|---|
| DE | 3430675 | 3/1986 |
| JP | 9-219275 | 8/1997 |

* cited by examiner

*Primary Examiner*—Hai Huynh
(74) *Attorney, Agent, or Firm*—Ostrolenk, Faber, Gerb & Soffen, LLP

(57) ABSTRACT

In an ignition electrode arrangement at a cylinder in an internal combustion engine, for example an Otto-engine, a first electrode and a second electrode co-operate with each other, the first electrode being arranged on an ignition device secured to a cylinder head. Both electrodes are movable in order to enable a change in the size of the spark gap and/or the position of the spark gap. The electrodes are each manipulated by an operating device that is controlled by a control unit included in the ignition system of the engine.

15 Claims, 2 Drawing Sheets

IGNITION ELECTRODE ARRANGEMENT AT AN INTERNAL COMBUSTION ENGINE

TECHNICAL FIELD

The invention relates to an ignition electrode arrangement for an internal combustion engine and to a related method.

STATE OF THE ART

In an internal combustion engine with spark ignition, use is normally made of an ignition electrode arrangement in which a positive electrode and an earth electrode are assembled in a sparking plug which is mounted removably in the cylinder head of the engine and has a fixed spark gap.

In order to achieve better combustion conditions in the case of inter alia low load, it is desirable to be able to use a larger spark gap than a conventional sparking plug allows, and the use has therefore been proposed of an electrode arrangement in which the sparking plug has only a positive electrode and the earth electrode is arranged on the piston of the cylinder. By selecting a suitable ignition time, it is in this way possible to obtain the desired electrode distance. However, a disadvantage is that, with a large spark gap, it is not always possible to produce a satisfactory spark because, for practical reasons, the ignition voltage has to be limited and is therefore not always adequate. In this connection, there is a risk that the spark will, instead of striking the piston, strike the cylinder head close to the sparking plug, with various disadvantages as a consequence.

In order to achieve a larger spark gap than with a conventional sparking plug, positioning a fixed earth electrode on the cylinder head has also been tried instead of having an earth electrode on the sparking plug. However, this solution does not allow the size of the spark gap to be changed, which is possible when the earth electrode is positioned on the piston.

THE OBJECT OF THE INVENTION

One object of the invention is to produce an improved ignition electrode arrangement. Another object is to make possible improved spark control and in this way improved combustion control. A further object is to bring about a variable spark position.

DISCLOSURE OF THE INVENTION

These objects are achieved by means of an ignition electrode arrangement having the features herein disclosed and by a method having the features herein disclosed.

By making both the electrodes movable, a possibility is afforded for changing the size and/or the position of the spark gap. By furthermore controlling the size of the spark gap as a function of the current operating situation, it is possible to produce an optimum ignition spark for the current operating situation, which in turn results in advantages with regard to the possibility of, in combination with other combustion-related parameters, such as, for example, ignition time, type of fuel/air mixture, the turbulence configuration in the cylinder, temperature, degree of supercharging, compression etc., refining the combustion process in order to achieve advantages with regard to the environment, fuel consumption, drivability in different situations etc.

Further advantages and features of the invention emerge from the description and patent claims below.

The invention is explained in greater detail below by means of exemplary embodiments shown in the appended drawing.

DESCRIPTION OF EXEMPLARY EMBODIMENTS

Figure 1:
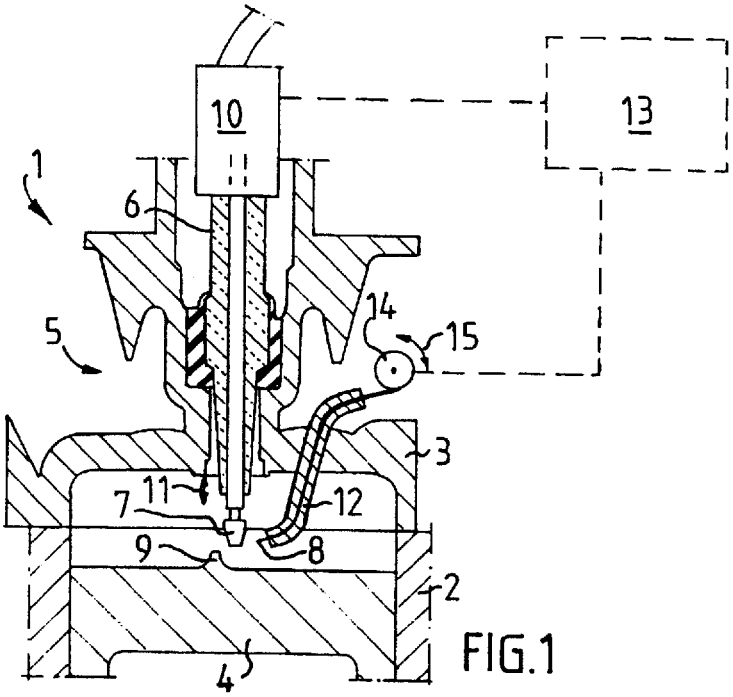
FIG. 1 shows a diagrammatic view of a cylinder in an engine with an ignition electrode arrangement according to the invention.

FIG. 1 shows diagrammatically a cylinder 1 in an internal combustion engine, otherwise not shown in greater detail, with spark ignition, in this case of the Otto type. A piston 4 reciprocates in a cylinder block 2 which is covered at the top by a cylinder head 3. The cylinder 1 is provided with an ignition electrode arrangement 5 for igniting a fuel mixture introduced into the cylinder. Customary inlet and outlet valves in the cylinder, as well as other conventional components, have been omitted for the sake of simplicity and clarity, but do of course form part of the engine described.

The ignition electrode arrangement 5 includes an ignition means 6 which is fastened removably in the cylinder head 3 and forms a first electrode 7, and a second electrode 8 mounted on the cylinder head 3. A second electrode 9, which is arranged on the piston 4 and is here designed as a raised portion laterally offset relative to the ignition means 6, is also present in addition to the second electrode 8.

The first electrode 7 is arranged movably in the ignition means 6 and can, by means of an operating device 10 arranged on the ignition means 6, be displaced to and fro in the direction of the double arrow 11, essentially in the longitudinal direction of the cylinder. By virtue of the fact that the first electrode 7 is therefore movable relative to the cylinder head 3 and relative to the piston 4, it is possible to vary the size of the spark gap by means of the operating device 10 which, for the purpose, can suitably be controlled by a control unit 13 forming part of the ignition system of the vehicle in order in this way to vary the size of the spark gap as a function of suitable operating parameters, according to requirements. It is also possible to make the control unit 13 control the ignition voltage also as a function of suitable operating parameters, according to requirements, and in this manner to achieve further improved ignition control.

The second electrode 8 is also mounted movably and can, by means of an operating device 14, be displaced to and fro in the direction of the double arrow 15. For this purpose, it runs in a sealed manner in a curved guide 12 in the cylinder head. The operating device 14, like the operating device 10, is also advantageously controlled by the control unit 13 forming part of the ignition system. In this connection, the second electrode 8 forms an earth electrode and can, if appropriate, be mounted on a roller in the operating device 14.

By virtue of the fact that the second electrode 8 mounted in the cylinder head is also movable, an improved possibility is afforded for setting a spark gap size which is suitable for a current operating situation, so that the spark has optimum effect.

Figure 2:
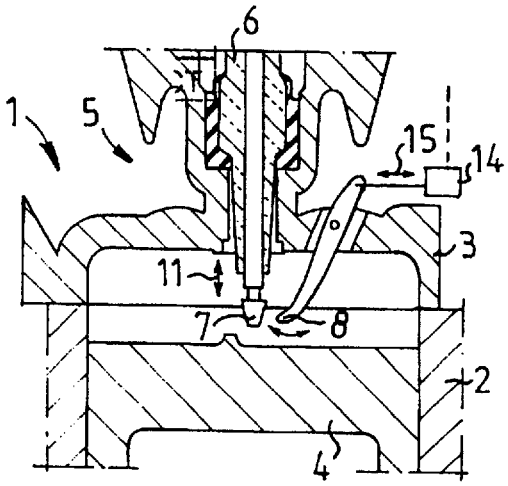
FIGS. 2–4 show variants of the embodiment in FIG. 1, FIGS. 5*a* and 5*b* show a view V—V in FIG. 4, with parts in different positions.

In the embodiment shown in FIG. 2, the first electrode 7 is movable in the same manner as in FIG. 1, while the second electrode 8 is mounted pivotably in the cylinder head 3, in a plane essentially parallel to the longitudinal direction of the cylinder, in order in this way to make it possible to change the size of the spark gap to the ignition means 6. The pivoting movement is controlled by means of the operating device 14 so as to impart a movement according to the double arrow 15. The necessary sealing between the second electrode 8 and the cylinder head 3 has been omitted here for the sake of clarity.

Figure 3:
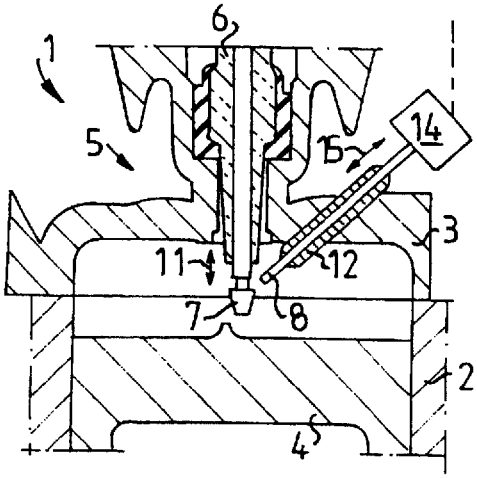

In FIG. 3, the second electrode 8 can be displaced axially to and fro in a guide 12 in the cylinder head 3. Displacement in the direction of the double arrow 15 is brought about by means of the operating device 14. The first electrode 7 is movable in the same manner as in FIG. 1.

Figure 4:
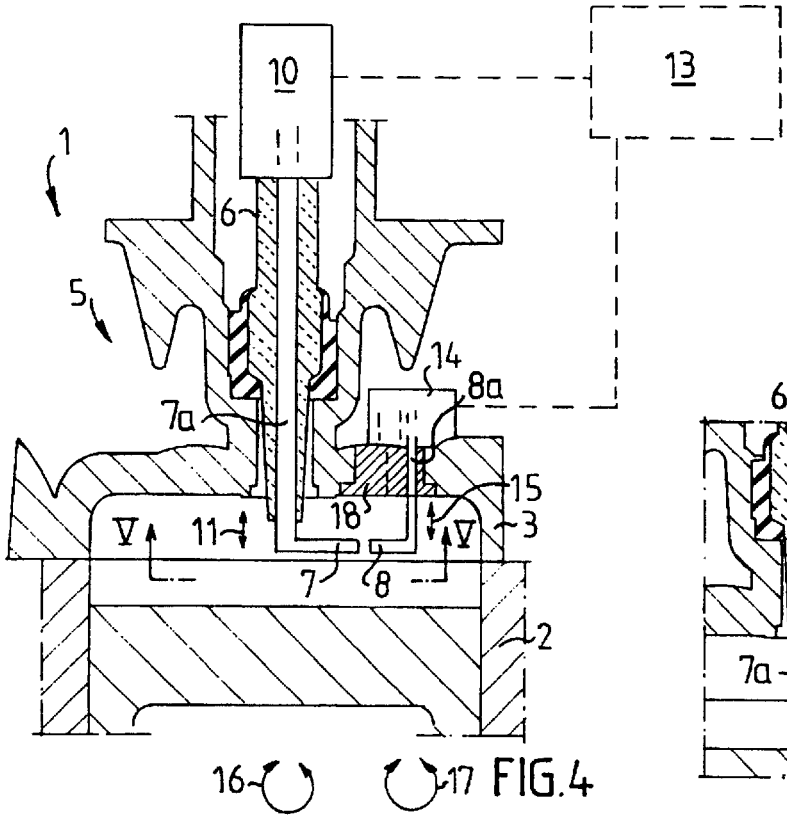
Figure 5A:
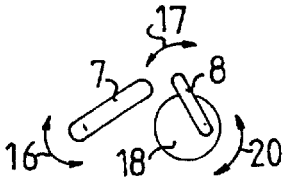

In FIG. 4, the first electrode 7 is not only axially displaceable in the direction of the double arrow 11 but also pivotable in the direction of the double arrow 16, essentially about the longitudinal direction of the ignition means 6. In a corresponding manner, the second electrode 8 is pivotable in the direction of the double arrow 17 in addition to being axially displaceable in the direction of the double arrow 15. In this case, the first electrode 7 constitutes an arm which projects radially from the end of a spindle 7*a* mounted movably in the ignition means 6. In a corresponding manner, the second electrode 8 constitutes an arm which projects radially from the end of a spindle 8*a* mounted movably in the cylinder head 3. The relative movement between the first and second electrodes 7, 8 according to the double arrows 16, 17 can be seen in greater detail in FIG. 5*a*, in which the electrodes are in one of many possible relative positions.

Figure 5B:
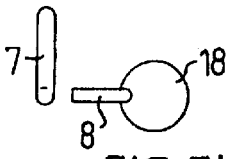

According to FIG. 4, the spindle 8*a* of the second electrode 8 is mounted in a holder 18 which is mounted rotatably in the cylinder head 3 and, by means of the operating device 14, can be rotated about an axis essentially parallel to the axis of the cylinder 1. By rotating the holder 18 according to the double arrow 20 in FIG. 5*a*, the second electrode 8 can also be moved in the lateral direction relative to the first electrode 7, for example from a position shown in FIG. 5*a* to a position shown in FIG. 5*b* closer to the first electrode 7. However, movement according to the double arrows 16 and 17 is also still possible.

Figure 6:
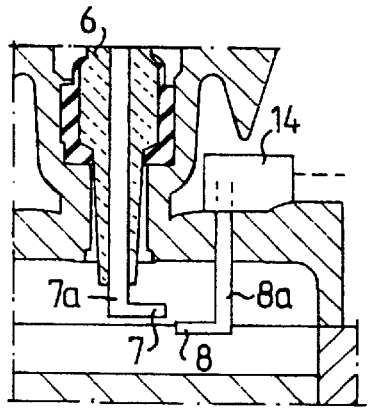
FIG. 6 shows a variant of the embodiment in FIG. 4.
Figure 7:
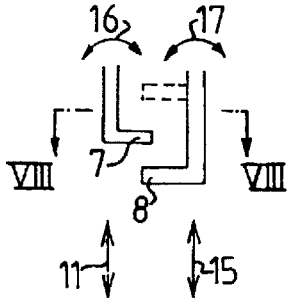
FIG. 7 shows a simplified part view from FIG. 6.
Figure 8:
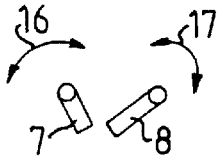
FIG. 8 shows a section along VIII—VIII in FIG. 7.

In the embodiment shown in FIG. 6, the spindle 8*a* of the second electrode 8 is mounted directly in the cylinder head 3 for movement according to the double arrows 15, 17 by means of the operating device 14. The first electrode 7 is movable in the same manner as in FIG. 4 and is therefore movable according to the double arrows 11, 16. Possible movements of the electrodes 7 and 8 are shown in greater detail in FIGS. 7 and 8.

In addition to the exemplary embodiments shown above, a number of other embodiments are of course possible within the scope of the invention., according to requirements and conditions.

If appropriate, the ignition means 6 can be combined with a device for fuel injection, the tip of this device suitably being designed so as to be displaceable/rotatable according to requirements. If appropriate, the second electrode 8 can also be combined with a fuel injection device arranged in a fixed or movable manner.

As shown, the invention can be applied to spark-ignited engines of the Otto type, but there is of course nothing to prevent the invention being applied instead to, for example, a two-stroke engine or another type of spark-ignited engine.

The adjustability of the electrodes and thus the adjustability of the size and/or the position of the spark gap proposed according to the invention make it possible in a suitable manner to change the spark gap and the spark position as a function of the current operating situation, if appropriate in combination with control of the ignition voltage. In this way, a possibility is afforded for influencing the combustion in the cylinder advantageously so that improvements can be achieved with regard to, for example, fuel consumption, drivability and environmental aspects.

In the embodiment shown, the first electrode is 35 intended to be positive and the second electrode negative. A reversed embodiment is nevertheless also possible. It is furthermore possible to arrange both the first and the second electrode in the ignition means and then to make both movable in the indicated manner.

What is claimed is:

1. Ignition electrode arrangement for a cylinder in an internal combustion engine, comprising a cylinder head which bears a first electrode and a second electrode and the electrodes interact with one another, at least the first electrode being arranged on art ignition means fastened in the cylinder head, both the first electrode and the second electrode are arranged movably relative to the cylinder head, in order to make at least one of a variable spark gap and a variable spark position possible, and the second electrode is arranged in the cylinder head, separately from the ignition means.

2. Ignition electrode arrangement according to claim 1, wherein the first electrode is movable essentially in the longitudinal direction of the cylinder.

3. Ignition electrode arrangement according to claim 1, wherein the first electrode is movable essentially in a plane at right angles to the longitudinal direction of the cylinder.

4. Ignition electrode arrangement according to claim 1, wherein the first electrode is movable both in the longitudinal direction of the cylinder and in a plane at right angles to the longitudinal direction of the cylinder.

5. Ignition electrode arrangement according to claim 1, wherein the first electrode is connected to an operating device, by means of which the first electrode can be moved.

6. Ignition electrode arrangement according to claim 5, wherein the operating device is controlled by a control unit forming part of the ignition system of the vehicle.

7. Ignition electrode arrangement according to claim 1, wherein the second electrode is thread-shaped and is axially movable in a guide arranged in the cylinder head.

8. Ignition electrode arrangement according to claim 1, wherein the second electrode is mounted pivotably in the cylinder head and is pivotable in a plane essentially parallel to the longitudinal direction of the cylinder.

9. Ignition electrode arrangement according to claim 1, wherein the second electrode is mounted pivotably in the cylinder head and is pivotable in a plane essentially at right angles to the longitudinal direction of the cylinder.

10. Ignition electrode arrangement according to claim 9, wherein the second electrode is displaceable in the longitudinal direction of the cylinder.

11. Ignition electrode arrangement according to claim 1, wherein the second electrode is connected to an operating device, by means of which it the second electrode can be moved.

12. Ignition electrode arrangement according to claim 11, wherein the operating device is controlled by a control unit forming part of the ignition system of the vehicle.

13. Method for generating an ignition spark in an internal combustion engine, comprising generating an ignition spark between a first electrode on ignition means fastened in a cylinder head and a second electrode, wherein the position of both the electrodes, one on the ignition means and the other one arranged in the cylinder head, separately from the ignition means is varied during operation in order to change the size of the spark gap.

14. Method according to claim 13, wherein the positions of both of the electrodes are varied during operation in order to change the position of the spark gap.

15. Method according to claim 13, wherein the size of the spark gap is varied as a function of the current operating situation, on the basis of control information from a control unit forming part of the ignition system of the vehicle.

* * * * *